US005307822A

United States Patent [19]

Egri

[11] Patent Number: 5,307,822

[45] Date of Patent: May 3, 1994

[54] EXPANDING AND DRYING TOBACCO

[76] Inventor: Laszlo Egri, Aeschengraben 16, CH-4061 Basel, Switzerland

[21] Appl. No.: 986,003

[22] Filed: Dec. 4, 1992

[30] Foreign Application Priority Data

Dec. 9, 1991 [CH] Switzerland ..... 3608/91

[51] Int. Cl.[5] ..... A24B 3/04

[52] U.S. Cl. ..... 131/296; 131/903

[58] Field of Search ..... 131/296, 903

[56] References Cited

U.S. PATENT DOCUMENTS

| | | | |
|---|---|---|---|
| 4,167,191 | 9/1979 | Jewell et al. . | |
| 4,513,758 | 4/1985 | Henzelin et al. | 131/296 X |
| 4,697,604 | 10/1987 | Brown et al. | 131/296 |
| 4,911,182 | 3/1990 | Dennis | 131/296 |
| 4,938,235 | 4/1990 | Hirsch et al. | 131/296 X |
| 5,031,644 | 7/1991 | Kramer | 131/296 X |

FOREIGN PATENT DOCUMENTS

| | | | |
|---|---|---|---|
| 0974059A2 | 3/1983 | European Pat. Off. . | |
| 0285811 | 10/1988 | European Pat. Off. | 131/296 |
| 2253882C3 | 5/1975 | Fed. Rep. of Germany . | |
| 2637124A1 | 3/1977 | Fed. Rep. of Germany . | |
| 3037885C2 | 7/1983 | Fed. Rep. of Germany . | |
| 3147846C2 | 7/1984 | Fed. Rep. of Germany . | |
| 3619816A1 | 12/1986 | Fed. Rep. of Germany . | |
| 3839529C1 | 4/1990 | Fed. Rep. of Germany . | |
| 2115677 | 9/1983 | United Kingdom | 131/296 |

OTHER PUBLICATIONS

*For Fragile Tobacco Material,* Proctor & Schwartz Inc., 1969.

*Primary Examiner*—Vincent Millin
*Assistant Examiner*—Raleigh W. Chiu
*Attorney, Agent, or Firm*—Fisher & Associates

[57] ABSTRACT

A process and an apparatus for expanding and drying tobacco by means of vapor and/or hot gas are described, in accordance with which the tobacco is metered into an interior space (4) delimited by at least two flat jets (3, 3'). The flat jets flow into the channel from mutually opposing slotted nozzles (2, 2') and are directed towards one another at an acute angle and take up and consequently accelerate the tobacco suddenly. After the velocity acceleration by the flat jets, the tobacco is deflected by means of transverse flow, accelerated again, expanded and dried.

14 Claims, 2 Drawing Sheets

EXPANDING AND DRYING TOBACCO

BACKGROUND OF THE INVENTION

1. Field of the Invention

In the effective expansion and/or drying of tobacco, optimum heat transfer plays an important role in relation to the proper use and effect of heat. To this end, in general increased relative speed between the gas-containing treatment medium and the solid, and a sudden drop in pressure from the higher pressure region to the lower region in various ways have been proposed.

2. Description of the Prior Art

A number of patent specifications describe the use of increased relative speed to improve the drying and/or expansion of moist tobacco. Thus, for example DE-PS 30 37 885 proposes deflection means which are offset opposite in a pneumatic transport tube in order in this way to alter, a number of times, the direction of motion and the relative speed of the tobacco length sections with respect to the gaseous heating and transporting medium. However, these deflection means result in the deposition of tobacco constituents on the walls of the pneumatic tube.

In accordance with DE-OS 36 19 816, it is proposed that the hot tobacco should be separated from the vapor or gas by means of a separator comprising a screen which extends at an angle of 135° to 155° with respect to the axis of the transporting pipe, at the downstream end thereof. An analogous proposal is described in DE-OS 36 19 015, with the difference that the tobacco-drying apparatus comprises two gas flow pipes with two separators which are connected to one another and that porous separators which are each arranged obliquely at an angle to one another should separate the tobacco from the gas. As a result of this system, the tobacco was to be subjected to acceleration twice through the gaseous medium.

The tobacco flowing at an angle and at high speed in the upward direction can be deposited against the face of the gas-permeable separators arranged obliquely with respect to the direction of flow, and can clog them.

With moist tobacco, in particular when the moisture content of the tobacco is above 35%, flow changes in a pneumatic hot-vapor tobacco transporting channel system result in undesirable deposition. This deposition occurs to the greatest extent where the flow change is the greatest, for example in the bent portion of a pneumatic transporting system. This is also the case with the method described in DE-OS 20 14 874. In accordance as a later patent specification of the same method, deposition as a result of cooling or condensation at the bent portion is supposed to be reduced.

DE-PS 38 39 529 describes a process and an apparatus for blowing cut tobacco material, in accordance with which a tobacco carrier gas stream is surrounded by a separately supplied gas stream in order thus to increase a number of times the relative speed between the tobacco material and the gas stream, but because of the previously effected surrounding of the tobacco material by the carrier gas this is achieved only inadequately and not over the entire channel cross-section. The additional gas stream is supplied by way of a plurality of slots which are constructed at an acute angle as an aperture in the channel casing in the direction of flow.

Further treatment of the tobacco after it has emerged from the treatment channel is illustrated only diagrammatically, without describing or claiming the type of treatment or drying. There is no mention of deflecting the direction of flow.

In accordance with DE-PS 33 15 274, a tobacco/gas mixture flows at very high velocity out of a horizontal transporting channel through a narrow nozzle into a dryer tube provided with bent portions. In order that the tobacco can be conveyed further, the flow velocity of the hot gas in the drying tube must be somewhat greater than that of the tobacco/gas mixture emerging from the nozzle. This necessitates an uneconomically large quantity of hot gas and involves intensive mixing or dilution of the tobacco with the gas.

When the tobacco suddenly enters a hot-air environment from the nozzle, the heat transfer caused by the turbulence can bring about an expansion of the tobacco, in particular with tobacco lengths which are more easily expandable. However, the conditions described in the above patent specifications do not sufficiently provide a more significant expansion of tobacco layers in order to bring about the desired expansion effect.

The publication DE-OS 26 37 124 describes the use of a venturi nozzle or a cross-sectional reduction in the tobacco transporting channel in order to increase the relative velocity between the hot gas-containing medium in the tobacco and thus to increase the expansion effect. The expansion effect can of course be further improved by tapering the cross-section of the tobacco transporting channel or by using a venturi nozzle, in the case of tobacco with a relatively high moisture content. The patent specification EP 074 059 is based on virtually the same principle. Here, the additional claim is made that the tobacco material is to be metered and conveyed at the "base point" of a free jet or of a nozzle. This may be ensured, inter alia, by the tobacco metering being directed directly toward the opening of the nozzle, as can be seen from FIGS. 3, 4, 5. The supply of the tobacco or its conveyance in the "base point" of a nozzle cannot be carried out in practice, since the jet flowing out of the nozzle has such a high velocity that it cannot at this point receive the tobacco within it. Only after the jet has widened out and has filled the transporting channel is there a possibility of the tobacco being embedded in this jet and transported further therewith. However, at this point the speed and temperature of the jet are reduced by the widening of its cross-section. This is why optimum exploitation of the heat transfer required for a proper expansion effect for cut leaf tobacco is reduced.

In accordance with DE-PS 31 47 846, equivalent to this patent specification, the tobacco was to be accelerated in the expansion zone and transported at an approximately constant speed, and then decelerated in a divergent flow with an increase in pressure. This construction may be ensured by the temporary narrowing of the channel cross-section, as illustrated in FIG. 1 of this printed specification. Admittedly, the speed acceleration and the reduction of a tobacco/vapor mixture is described in the above-cited DE-OS 26 37 124 by using a venturi nozzle, and "P. B. Dispersionstrockner" cited in DE-PS 22 53 882, that these constructions cannot be regarded as optimum because of the limited possibility of tapering the channel cross-section and because of the mechanical wear of the tobacco by the channel wall.

SUMMARY OF THE INVENTION

It has now been found that an improvement in the tobacco supply metering and in particular flow velocity conditions of the tobacco/gas stream, and a special type of deflection as a result of transverse flow, can result in an additional improvement to the effect.

The object of the invention is to improve the expansion effect and the drying and to carry this out without using gases or condensed gases at an overpressure, by using only water vapor and/or air in a simple apparatus in the atmospheric range.

BRIEF DESCRIPTION OF THE DRAWINGS

The invention will be explained by way of example below with reference to the drawing, in which.

DETAILED DESCRIPTION OF THE PREFERRED EMBODIMENT

Figure 1:
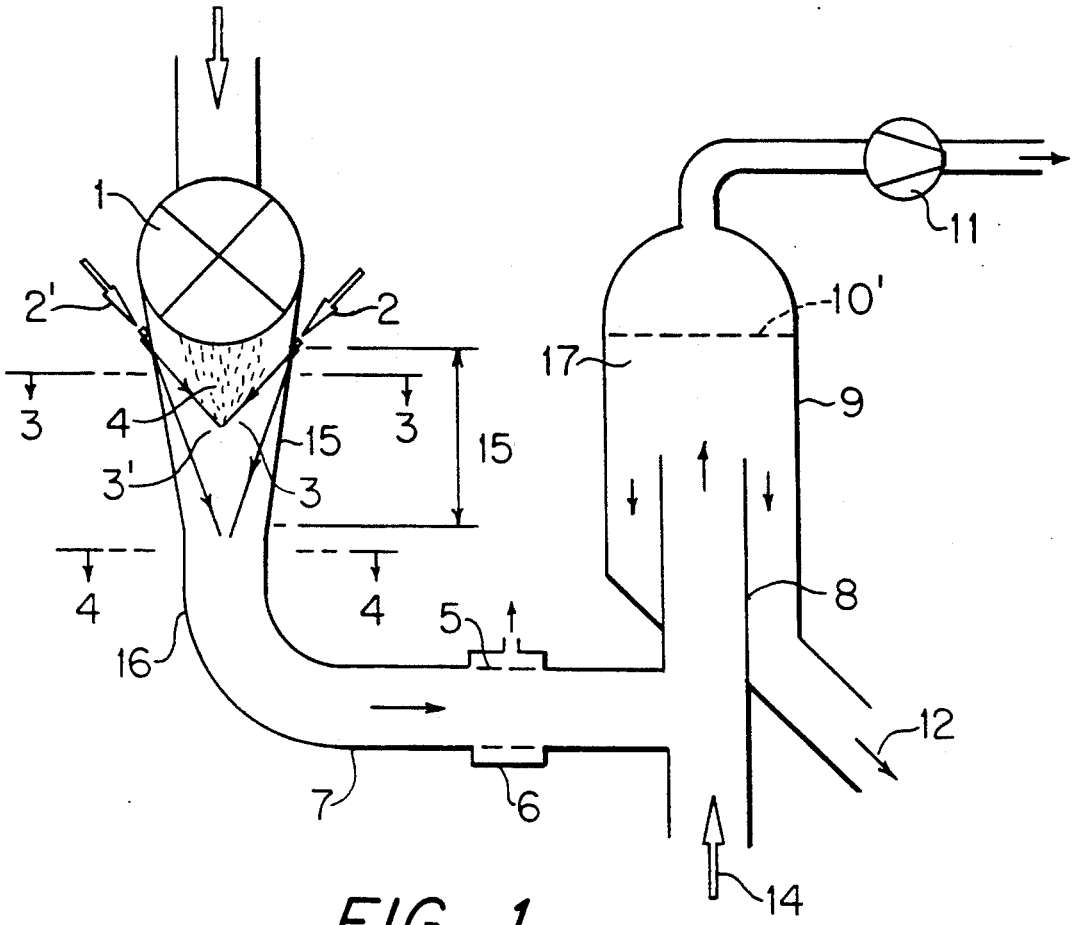
FIG. 1 is a side elevational view of an apparatus for expanding and drying tobacco constructed in accordance with a preferred embodiment of the invention.
Figure 3:
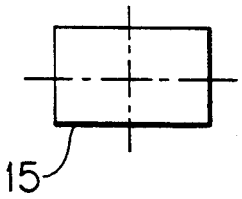
FIG. 3 is an expanded sectional view of a channel of the apparatus, taken along line III—III of FIG. 1.
Figure 5:
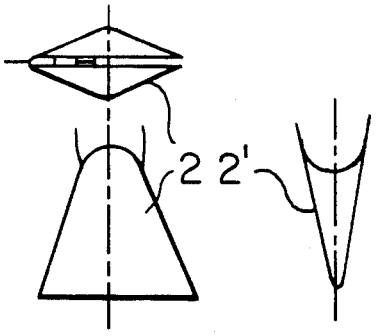
FIG. 5 illustrates the flat nozzle utilized by the apparatus in FIGS. 1 and 2.
Figure 4:
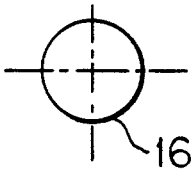
FIG. 4, is an expanded sectional view of another channel of the apparatus, taken along the line IV—IV of FIG. 1.

In accordance with the proposed process, the tobacco is supplied from a metering apparatus 1 into a channel section of the same diameter after loosening or separating of the tobacco fibres, which can be done by using known vibratory channels and/or needle rollers. This is particularly advantageous with cut leaf tobacco or so-called "lamina". If it is desired to incorporate the tobacco into a vapor jet and for this jet to emerge from the nozzle at high speed, the difficulty may arise that the tobacco penetrates into the jet only very unevenly or not at all, despite the suction effect.

According to the invention, it has now been found that an optimum and gentle treatment of the tobacco is made possible if the latter is metered into the interior space 4 which is laterally delimited by laterally widened surfaces of flat jets 3, 3', comprising vapor and/or hot gas and intersecting in the direction of flow, which flow out of two mutually opposing nozzle openings at an angle of 5° to 60° with respect to the channel axis into this channel, if the tobacco is transported at high speed by means of this medium and if this high speed is increased again at least by once changing the direction of flow by a transverse flow by means of a separate gas stream.

The flow velocity of the flat jets 3, 3', which enclose the tobacco from two sides and which preferably flow into a rectangular channel section 15 from a respective flat jet nozzle 2, 2' arranged outside the flat sides of rectangular channel section 15, is between 300 m/sec. and 100 m/sec. at the tobacco take-up point of the jets as far as their point of intersection. In this case, the tobacco from the vapor/gas jet surface carrying it is not mixed into the jet by contact with the channel section but at the point at which the two mutually facing jets meet. As a result, the mechanical wear or the risk of damaging tobacco particles is substantially reduced and the tobacco is subjected to additional acceleration.

In a preferred embodiment of the process mentioned, the tobacco may be metered into a vertical channel section 15. Preferably, the tobacco is metered through the upper opening of rectangular channel section 15, the tobacco falling onto the laterally widening surfaces of vapor-containing "blanket" 4, 4' flowing out of mutually opposing openings of preferably a respective flat jet 2, 2' and is accelerated. Furthermore, the tobacco is additionally accelerated at the point of intersection of the two flat jets 4, 4', then its flow velocity is decelerated by the fact that some of the transporting vapor is drawn off. This is effected in a portion of the transporting channel which is constructed as a gas-permeable channel section 5 through which some of the vapor may flow. As a result of the casing 6 surrounding this channel section 5, the vapor can be removed or preferably returned to the system after overheating again.

The flow velocity by vapor removal can subsequently additionally be reduced by widening the channel cross-section. The tobacco/vapor and/or hot gas mixture emerges from the vertical channel section 16 at a velocity of 3 m/sec. to 10 m/sec. and is deflected into a horizontal channel section by means of a separate hot gas-containing stream 13 at a velocity of 11 m/sec. to 60 m/sec. by transverse flow. This tobacco-containing flow may be deflected from the horizontal channel section 7 by another deflection by means of a separate gas flow 14 at a higher velocity than was used in the horizontal channel section 7 into a vertical channel section 8 and thus accelerated again. Furthermore, the tobacco may also be transported without transverse flow past a bent portion in a lengthened vertical channel section 8. The vertical channel section 8 is surrounded by a pipe 9 of widened cross-section to form a tobacco-separating zone. After emerging from the channel section 8 into the interior space 17 surrounding this, the tobacco is deflected by the air resistance and leaves this interior space 17 downward by gravity after expansion and drying.

Another possible embodiment consists in the tobacco being metered through a vertical channel into a horizontal one. In this case, the two flat jets 3, 3' must flow out of openings which are arranged on mutually opposing sides but are offset with respect to one another. The differing spacing of the two flat jets 3, 3' between the respective nozzle openings and their point of intersection would bring about an unequal velocity of the two flat jets. To prevent this, in this case the diameters of the individual nozzle openings and the vapor pressures in front of the nozzles would have to be matched to these requirements.

The use of two flat jets which surround the tobacco from two mutually opposing sides and mix therewith at their point of intersection also has the advantage over the use of round jets that the flat jets widen chiefly only laterally during their flow and not in their overall cross-section, as a result of which their velocity is less reduced with distance from the nozzle opening. As a result of the underpressure prevailing in the channel system as a result of the high flow velocity, the tobacco metered in is deflected from the nozzle opening and falls onto the widening surface of the flat jet. It is advantageous to use only one respective flat jet with relatively wide nozzle openings and to arrange the position thereof outside the channel wall. Thus, the tobacco falls onto the surface of the laterally widening vapor jets with a greater degree of certainty.

In order to further improve the expansion effect which is already produced with the described means of metering tobacco in from at least one jet comprising vapor and/or hot gas, in accordance with the invention the deflection of the tobacco/vapor mixture by transverse flow 13 and 14 is proposed.

It has been found that if there penetrates into a jet comprising comminuted tobacco and vapor and/or hot gas a flow 13 or 14 directed transversely thereto and the tobacco-containing jet is deflected, the heat transfer of gas to the tobacco and thus also the drying and expansion effect are significantly improved. In this case, a plurality of action components together result in the improved effect. The transverse flow is accumulated in front of the solid-containing jet and a pressure gradient transverse to its direction of propagation is thus built up. It may be assumed that the surprisingly large effect achieved in the practical tests according to the invention is obtained by the cooperation of the two components comprising pressure build-up and reduction with transverse flow, and the difference in transporting velocity between gas and tobacco.

As a result of the manner of deflection according to the invention by transverse flow of the jet containing the tobacco and the transporting medium, together with the increase in flow velocity according to the invention in supplying the tobacco and in slowing it before the deflection, the expansion and drying effect could be substantially improved by comparison with the solutions known hitherto. In accordance with the invention, the deflection may take place from the horizontal to the vertical direction or from the vertical to the horizontal direction. It is also possible to use a triple deflection, for example if the tobacco/transporting medium mixture is deflected from the vertical to the horizontal direction and from this back to the vertical direction.

With the deflection of the gas/solid mixture flowing out of a horizontal channel section 7, directed upward by an auxiliary jet 14, the auxiliary jet must overcome the resistance caused by the weight of the tobacco (gravity), as a result of which it is subjected, before the deflection of the horizontal jet into the connection space between the horizontal and the vertical channel, to an accumulation action and then to a relatively large drop in pressure. The relaxation time, that is to say the time the tobacco particles need to adjust to the new direction of flow, is in this case also larger, as a result of which the effect of the heat transfer is additionally improved.

The use of a gas-permeable channel section 5 in the horizontal channel section 7 makes it possible to remove some of the transporting medium, which may be returned to the system again, and at the same time reduces the flow velocity of the jet. As a result, not only may a disadvantageous impact of the solid against the wall of the vertical channel section 8 be prevented, but an economic advantage is also thus achieved. The gas and/or vapor quantity required for the additional acceleration may in fact be reduced and the diameter of the horizontal and vertical channel sections can be kept approximately the same.

The section length and the porosity of this channel section are selected such that with a given tobacco/gas flow velocity there is no lateral deviation of the stream band and consequently no deposition or clogging against the porous surfaces of this porous channel section 5.

With the original tobacco-transporting vapor and/or hot gas flow, the weight ratio of tobacco to vapor is between 1:0.7 and 1:4. The weight ratio between the first tobacco-transporting treatment medium 4, 4' and the deflecting treatment medium 13 or 14 in the deflection zone is between 1:1 and 1:2.

In the last phase, the tobacco preferably passes, after the appropriate deflection, out of the channel section 8 into a pipe or "tower" 9 of larger diameter than that of the channel section 8. In order to further reduce the flow velocity in the second channel, the cross-section at the exit end of the channel section 8 may be widened. The free space above the centrally arranged channel section 8 should be dimensioned such that tobacco emerging therefrom into the wider tube 9 is decelerated by the air resistance and as a consequence of its gravity changes its direction of flow. The tobacco will fall in free-fall between the outer channel wall 8 and the inner so-called "tower" wall 9, after changing its direction of flow by 180°, into the open onto a conveyor belt and is transported away with the desired degree of dryness.

The tobacco which falls downward in the pipe between the outer wall of the relatively short vertical channel 8 and the inner wall of the pipe 9 encasing the latter at a spacing may be subjected to an increase in the dwell time by means of an additional dry gas which slowly flows in upward, preferably a hot gas.

The incoming flow velocity of a separate gas which slowly flows upward from the base side of the tower in counter-current with respect to the downwardly falling tobacco should as far as possible not exceed the velocity of 1 m/sec.

This counter-current should be adjusted such that it does not produce any accumulation of material and the tobacco may leave the drying tower by gravity.

As a result of the said repeated relative velocity increase and the change in the direction of flow, heat transfer and energy utilization are significantly improved, as a result of which an extremely economic drying, expansion or removal of the undesired volatile substances may be achieved.

In the case of a requirement for more intensive drying, two treatment units, in particular two so-called tower systems in which drying chiefly takes place, may be connected in series with one another.

As may be seen from the drawing, the apparatus comprises a tobacco-supplying channel from which the tobacco is metered through a sluice gate 1 and preferably then via a needle roller in a vertical rectangular transporting channel section 15 and is loosened. Outside the opposing flat channel walls (section III—III) there are arranged, at the top, directly after the metering apparatus a respective wide flat nozzle 2, 2' from which two flat carpet-like laterally widened flat jets 3, 3' comprising vapor and/or hot gas flow downward and intersect at an acute angle in the direction of tobacco flow. The tobacco falls into the interior space 4, which is formed by the two flat jets 3, 3' comprising vapor or hot gas, onto the laterally widening flat jets, which abruptly accelerate and transport the tobacco. To reduce the velocity of the tobacco and the vapor and/or hot gas, there can be provided further on, preferably in the channel section 16 of round construction, a gas-permeable channel section 5 through which some of the vapor escapes into a double casing 6 and is returned to the system. (Not illustrated in the drawing.)

Figure 2:
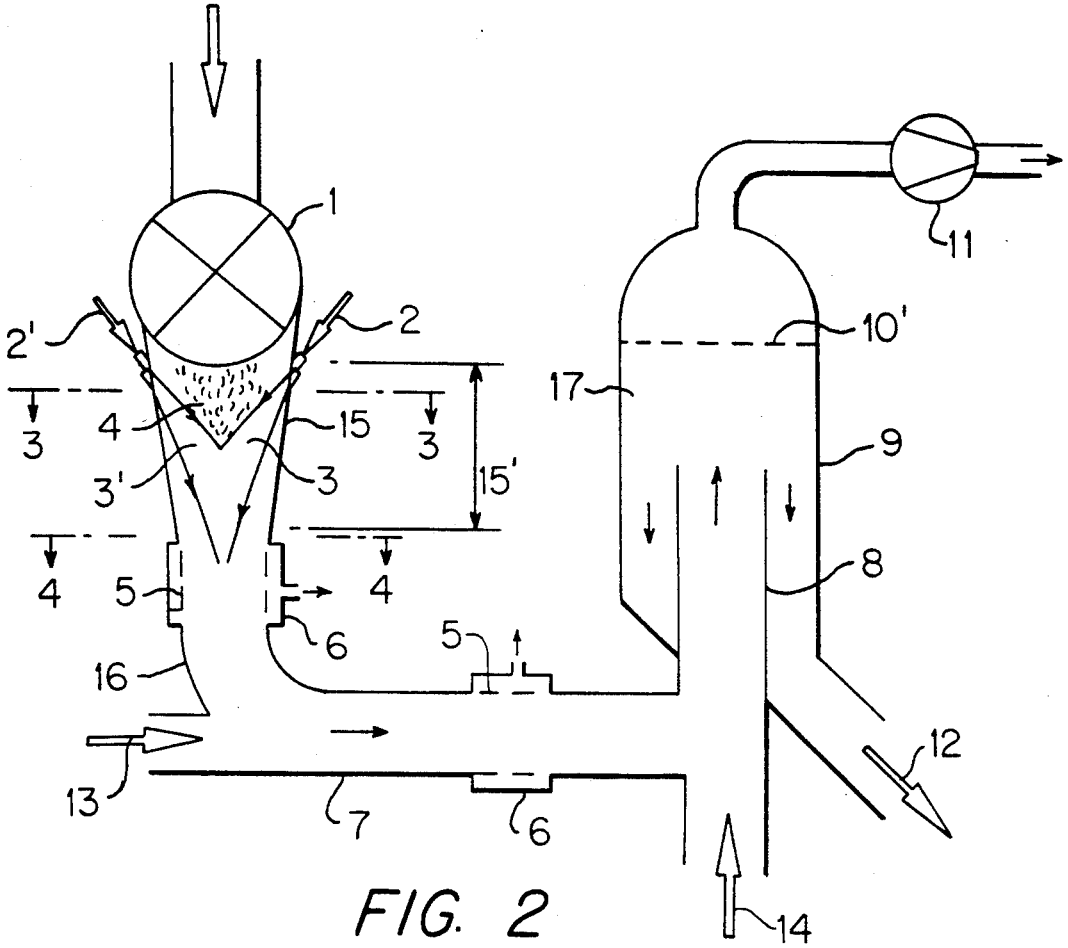
FIG. 2 is a side elevational view of an alternate embodiment of the apparatus of FIG. 1.
Figure 6:
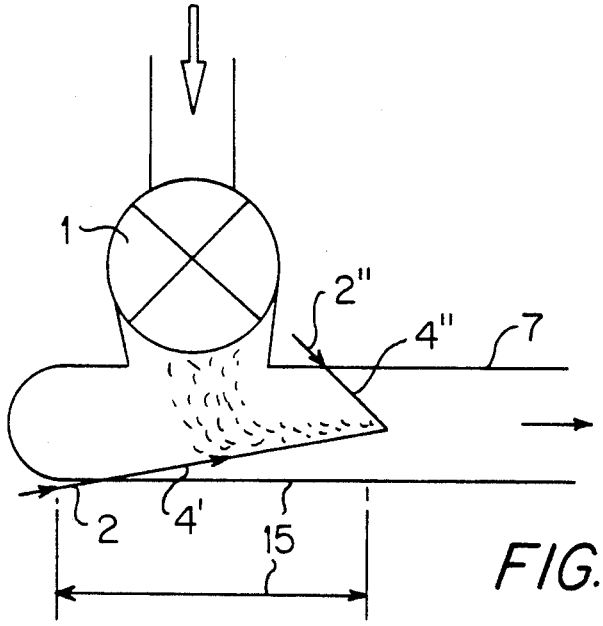
FIG. 6 is a side elevational view which shows an alternate arrangement of the flat nozzles and the metering in of the tobacco material.

The channel may be lengthened in the horizontal direction 7 by a bent portion (FIG. 1). A better or more effective solution is for the vertical channel section to open directly into a horizontal pipe 7 (see FIG. 2) and the tobacco is subjected to deflection by transverse flow by separate hot gas. The horizontal channel 7 may also be provided with a gas-permeable channel section 5, similarly to that described above. After the reduction in flow velocity, the tobacco may again be deflected into a vertical channel section 8 and change its flow direction downward, as a result of the air resistance, or as a result of gravity, in a wider pipe 9, a so-called "tower", surrounding this channel section 8. The vapor-containing hot gas which flows upward by means of the suction ventilator 11 is separated by the screen 10' from the tobacco falling downward as a result of gravity and leaves the intermediate space between the outer wall of the vertical channel section 8 and the widened pipe 9 or "tower" downward by way of the opening 12.

EXAMPLE 1

Cut Burley tobacco with a moisture content of 27%, after loosening with a needle roller, is passed through a sluice gate 1 into the vertical rectangular channel 15 of the channel walls in mutually opposing positions of two flat jet nozzles 2 out of which vapor flows in at a temperature of 220°-250° C. The tobacco is deflected upward out of the horizontal channel section 7 by means of an auxiliary gas stream 14 at a temperature of 140° C.-180° C. The tobacco leaves the exit opening 12 of the "tower" downward, having been dried and expanded. The temperature and flow velocity of the gas flowing upward in the channel is regulated such that the tobacco leaves the "tower" with a moisture content of 11.5%.

The untreated tobacco and the expanded tobacco are set to 12% moisture after conditioning.

The packing capacity of the tobacco was measured in a Brogwaldt densimeter (20 g of tobacco was loaded by a 3 kg weight in a cylinder of 6 cm diameter for 30 sec., and the height of the tobacco column was measured after the pressure was released.

| Height of the tobacco column | | |
|---|---|---|
| Untreated | Expanded | Increase in packing capacity |
| 33.83 mm | 50.80 mm | 50% |

EXAMPLE 2

Cut Virginia tobacco was treated as in Example 1.

| Height of the tobacco column | | |
|---|---|---|
| Untreated | Expanded | Increase in packing capacity |
| 28.93 mm | 57.47 mm | 100% |

What is claimed is:

1. A process for expanding and drying moist tobacco by means of vapor or hot gas, said process comprising the steps of:

metering said moist tobacco into an interior space which is delimited by at least two flat jets, said flat jets for providing vapor or hot gas which effects expansion of said moist tobacco, said flat jets being directed towards one another at an acute angle;

consequently suddenly taking up and accelerating said expanded tobacco to be treated in a first transport channel in order to generate a flow velocity associated with said expanded tobacco, substantially reducing said flow velocity at least by the removal of a portion of said vapor, and subsequently supplying said expanded tobacco to a drying means.

2. The process as claimed in claim 1, wherein said flow velocity of said tobacco is accelerated by said flat jets and said flow velocity is reduced at least once by the removal of a portion of said vapor from a section of said first transport channel.

3. The process as claimed in claim 2, wherein said flow velocity of said tobacco is accelerated by a deflection means which is disposed to create a flow substantially transverse to said first transport channel.

4. The process as claimed in claim 1, wherein said flat jets flow into said first transport channel from flat jet nozzles which are arranged in or outside opposing first channel wall regions and are directed towards a central axis for said first transport channel at an angle of 5°-60°.

5. The process as claimed in claim 1, wherein said tobacco is supplied into said interior space and said tobacco and said vapor or said hot gas is transported in an at least partially rectangular channel.

6. The process as claimed in claim 1, wherein said reducing of said flow velocity is carried out by removing a portion of said vapor through at least one gas-permeable section of a second channel, said second channel connected to said first channel.

7. The process as claimed in claim 1, wherein a transverse flow of said tobacco is effected in said channel by deflecting a flow direction associated with said flow velocity from a vertical to a horizontal direction and from there upward into a vertical channel section connected thereto, said deflection carried out in each case by a separate hot gas-containing medium.

8. The process as claimed in claim 1, wherein said flow velocity of said flat jets which flow in said channel from opposing sides thereinto is, in contact with said tobacco, between 100 m/sec. and 300 m/sec. and, on said tobacco's introduction to change in direction of flow by transverse flow into a second channel section connected to said first channel section at a 90° angle, between 3 m/sec. and 10 m/sec.

9. The process as claimed in claim 1, wherein said flow velocity of said vapor or hot gas stream containing said tobacco is between 11 m/sec. and 60 m/sec. after deflection by means of a separate gas-containing stream in a second channel section attached to said first channel section.

10. The process as claimed in claim 1, wherein said tobacco is subjected to a number of deflections, the last change in the direction of said flow velocity being from a horizontal channel section to a vertical channel section connected thereto by means of an additionally introduced gas stream, said vertical channel section opens upward into a pipe having a widened diameter, and said tobacco emerging from said vertical channel section emerges downward between said vertical channel section and said pipe surrounding said vertical channel section from said pipe by gravity.

11. The process as claimed in claim 1, wherein said vapor has a temperature between 220° and 250° after taking up the tobacco.

12. The process as claimed in claim 1, wherein said tobacco comprises either cut comminuted tobacco lengths or tobacco lamina.

13. The process as claimed in claim 1, wherein said flat jets provide a mixture of said vapor and said hot gas.

14. An apparatus for expanding and drying tobacco, said apparatus comprising:

at least a tobacco-metering sluice gate, a rectangular expansion channel section which is connected to said sluice gate, said rectangular expansion channel extending vertically downward and having a respective blanket-like vapor or hot gas containing flat jet flowing in through flat nozzles arranged in or outside wall of said rectangular expansion channel and opposite one another, said two flat jets intersecting one another at an acute angle for taking up said tobacco in an interior space delimited by said rectangular expansion channel, said rectangular expansion channel continues from a vertical to a horizontal direction, respective vertical or horizontal channel section being provided to create a transporting channel, said transporting channel provided with a gas-permeable section therein, said horizontal channel section opening into a separate vertical channel section which is surrounded by a pipe having a large internal cross-section, and from said vertical channel section said tobacco emerging downward in an expanded and dried state and said vapor or hot gas emerging upward through a screen by means of suction removal.

* * * * *